US009666936B2

(12) United States Patent
Hirayama et al.

(10) Patent No.: US 9,666,936 B2
(45) Date of Patent: May 30, 2017

(54) ANTENNA DEVICE

(71) Applicant: Kojima Industries Corporation, Aichi (JP)

(72) Inventors: Tomiyasu Hirayama, Aichi (JP); Kimitaka Kuramoto, Aichi (JP)

(73) Assignee: Kojima Industries Corporation, Toyota-shi, Aichi (JP)

( * ) Notice: Subject to any disclaimer, the term of this patent is extended or adjusted under 35 U.S.C. 154(b) by 210 days.

(21) Appl. No.: 13/972,672

(22) Filed: Aug. 21, 2013

(65) Prior Publication Data

US 2014/0062807 A1 Mar. 6, 2014

(30) Foreign Application Priority Data

Aug. 31, 2012 (JP) ..... 2012-192586

(51) Int. Cl.
*H01Q 1/32* (2006.01)
*H01Q 1/12* (2006.01)

(52) U.S. Cl.
CPC ..... *H01Q 1/325* (2013.01); *H01Q 1/1214* (2013.01); *H01Q 1/3275* (2013.01)

(58) Field of Classification Search
CPC ..... H01Q 1/325
USPC ..... 343/711–715
See application file for complete search history.

(56) References Cited

U.S. PATENT DOCUMENTS 5,177,493 A * 1/1993 Kawamura ..... H01Q 1/3275 343/713
5,945,956 A * 8/1999 Izawa ..... B29C 49/20 29/600
7,586,459 B2 * 9/2009 Noro ..... H01Q 1/3291 343/711
2006/0038726 A1 * 2/2006 Iacovella ..... H01Q 1/1207 343/713
2006/0244667 A1 * 11/2006 Thompson et al. ..... 343/713
(Continued)

FOREIGN PATENT DOCUMENTS

JP S61-274402 A 12/1986
JP 2002-344218 A 11/2002
JP 2008-085386 A 4/2008
(Continued)

OTHER PUBLICATIONS

Translated Hirayama, Tomiyasu JP 02009158990.*
(Continued)

*Primary Examiner* — Dameon E Levi
*Assistant Examiner* — Hasan Islam
(74) *Attorney, Agent, or Firm* — Eric D. Babych; Brinks Gilson & Lione

(57) ABSTRACT

The antenna device is disposed inside a vehicle exterior accessory such as a spoiler which is mounted on the exterior of the vehicle body. An amplifier substrate is fixed to a bracket, amplifies wave signals received from an antenna element, and outputs the amplified signals. A GND bolt fixes the bracket to the vehicle body and electrically connects between the bracket and the vehicle body. An amplifier cover is fixed to the bracket to cover the amplifier substrate. An elastic member is provided covering the outer periphery of the amplifier cover between the amplifier cover and the vehicle body. The elastic member is compressed as the amplifier cover is pressed against the vehicle body.

4 Claims, 2 Drawing Sheets

(56) References Cited

U.S. PATENT DOCUMENTS

| | | | |
|---|---|---|---|
| 2011/0112509 | A1 | 5/2011 | Nozaki et al. |
| 2013/0249748 | A1 | 9/2013 | Togura et al. |

FOREIGN PATENT DOCUMENTS

| | | | | |
|---|---|---|---|---|
| JP | 2008085386 | * | 4/2008 | ..... H01Q 1/22 |
| JP | 02009158990 | * | 7/2009 | ..... 343/713 |
| JP | 2010274821 | | 12/2010 | |
| JP | 2012-65184 | | 3/2012 | |
| WO | WO 2010/004671 A1 | | 1/2010 | |
| WO | WO 2012/067243 A1 | | 5/2012 | |

OTHER PUBLICATIONS

Notice of Grounds for Rejection with English Translation for related Japanese Application No. 2012-192586, dated Feb. 2, 2016 (9 pages).

* cited by examiner

ANTENNA DEVICE

This application claims priority to Japanese Patent Application No. 2012-192586, filed on Aug. 31, 2012, which is incorporated herein by reference in its entirety.

BACKGROUND

The present invention relates to an antenna device disposed inside a vehicle exterior accessory which is mounted on the exterior of a vehicle body.

Additional parts mounted on a vehicle body, such as spoiler, wing, and bumper, are known as vehicle exterior accessories. Vehicles are further mounted with a transmitter/receiver such as for AM radio, FM radio, television, and GPS. Inventions which improve a vehicle design by disposing a receiving antenna for a radio or the like inside a vehicle exterior accessory such as a spoiler, and wing are known (for example, JP 2012-65184 A and JP 2010-274821 A).

An antenna device includes an antenna element which receives wave signals and an amplifier which amplifies the wave signals received by the antenna element and outputs the amplified signals. In related arts, a ground (GND) is positioned away from an amplifier, resulting in lowered performance of the antenna device. Further, an amplifier is fixed to a vehicle exterior accessory such as a spoiler with a nail-shaped element or the like, while vehicle exterior accessories are fixed to a vehicle body by a fastening bolt. Because vehicle exterior accessories are made of resin, when a vehicle exterior accessory is expanded or contracted by heat, the amplifier is displaced along with the vehicle exterior accessory. Because the fastening bolt does not move, on the other hand, it has been required to provide a spring with a grounding bracket to minimize the distortion due to the heat expansion or contraction.

Further, the amplifiers are required to be waterproof because water such as rain may penetrate into vehicle exterior accessories. In related arts, the amplifiers are molded (resin molding) or sealed with rubber in order to waterproof the amplifier. However, in case of molding, as load is applied to an amplifier substrate by pressure or the like when forming, there is a risk that elements on the substrate may be damaged. As described above, prior arts have a problem of cost increase because of the increase in the number of parts due to required measures for heat expansion or contraction and waterproofing. Further, as a spring is used as measures for heat expansion or contraction, it is necessary to prepare a mounting space for the spring. As a result, there is a risk that types of vehicles which are capable of mounting the antenna device may be limited.

Further, when the amplifier is fixed with a nail-shaped element to a vehicle exterior accessory, the amplifier may be vibrated due to vibrations or the like of the vehicle, resulting in an occurrence of abnormal noise. If a member such as a cushion is provided as measures against such abnormal noise, a problem of manufacturing cost increase arises. Further, because it is possible that a clearance (space) is created between the nail-shaped element and the amplifier due to heat expansion or the like of the vehicle exterior accessory, the amplifier may be caused to come away from the nail-shaped element. This raises a risk of occurrence of abnormal noise or damage in the nail-shaped element.

SUMMARY

An object of the present invention is to provide an antenna device which is disposed inside a vehicle exterior accessory and is capable of improving performance of an antenna, preventing water from penetrating into an amplifier, and further reducing influence from heat expansion and contraction of a vehicle exterior accessory.

The present invention provides an antenna device disposed inside a vehicle exterior accessory mounted on the exterior of a vehicle body, the antenna device comprising: an amplifier which amplifies a wave signal received by an antenna element and outputs the amplified signal; a bracket to which the amplifier is fixed; a fixing member which fixes the bracket to the vehicle body and electrically connects between the bracket and the vehicle body; an amplifier cover which is fixed to the bracket and covers the amplifier; and an elastic member provided covering an outer periphery of the amplifier cover between the amplifier cover and the vehicle body such that the elastic member is compressed as the amplifier cover is pressed against the vehicle body.

Further, the fixing member may include a nut and a GND bolt which is fixed to the bracket; and the elastic member is compressed by tightening and fixing the bracket to the vehicle body by the bolt and the nut.

Further, the bracket may be enclosed inside the amplifier cover.

According to the present invention, it becomes possible to improve performance of an antenna, prevent water from penetrating into an amplifier, and further reduce influence from heat expansion and contraction of a vehicle exterior accessory.

BRIEF DESCRIPTION OF THE DRAWINGS

Preferred embodiments of the present invention will be described in detail base on the following figures, wherein.

DETAILED DESCRIPTION

Figure 1:
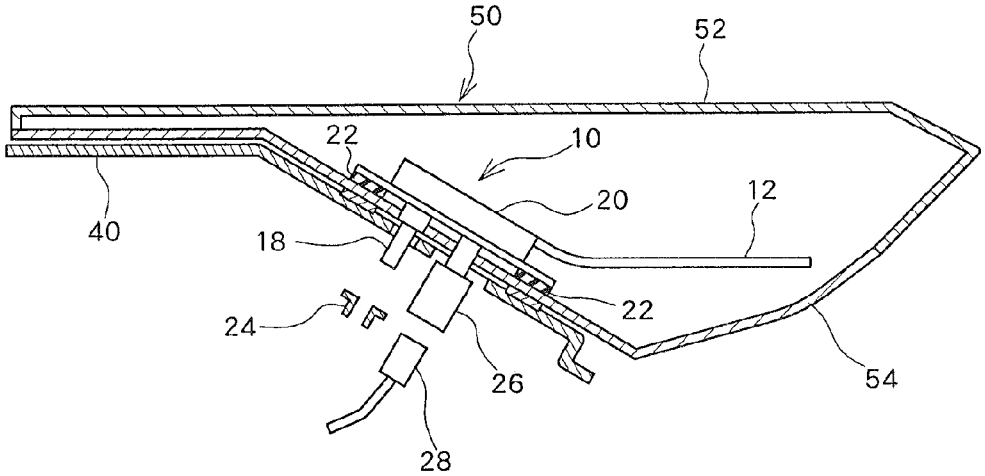
FIG. 1 is a cross-sectional view with an antenna device according to an embodiment of the present invention mounted inside a spoiler.
Figure 2:
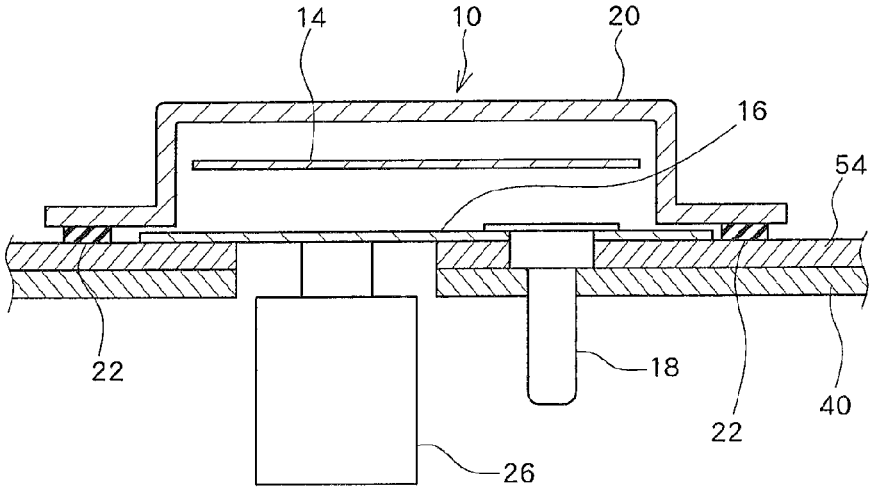
FIG. 2 shows a cross-sectional view of an antenna device according to an embodiment of the present invention.
Figure 3:
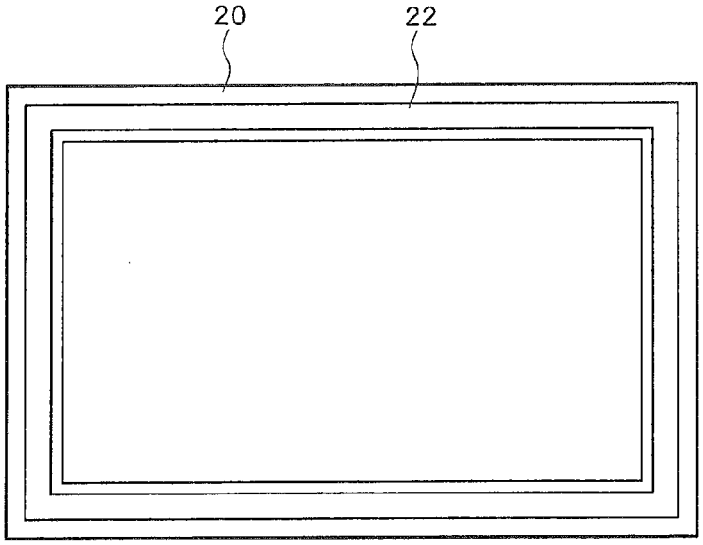
FIG. 3 is a plan view of an amplifier cover according to an embodiment of the present invention.

One example of an antenna device according to an embodiment of the present invention is shown in FIGS. 1 to 3. As shown in FIG. 1, a spoiler 50 which is an example of a vehicle exterior accessory is mounted on a rear end portion of a metal vehicle body 40. The spoiler 50 is a hollow body made of resin including an upper panel 52 and a lower panel 54. The spoiler 50 has an external shape which reduces air resistance of a vehicle while running. The spoiler 50 extends in the transverse direction of the vehicle body 40.

An antenna device 10 according to the present embodiment is mounted inside the spoiler 50. As shown in FIGS. 1 and 2, the antenna device 10 includes an antenna element 12, an amplifier substrate 14, a bracket 16, a GND bolt 18, an amplifier cover 20, an elastic member 22, and a nut 24. The antenna device 10 receives wave signals such as for digital television broadcast and radio broadcast by the antenna element 12, and amplifies the received wave signals using the amplifier substrate 14 to supply the amplified signals to a receiver (not shown).

The antenna element 12 is a conductor of, for example, metal wire, line-shaped metal plate, and a lead wire. The antenna element 12 may also be formed by a relatively soft metal material such as copper foil and conductive paste printed material, or by a relatively hard metal which is formed in a shape fitting the shape of the spoiler 50 when mounted inside the spoiler 50. An end portion (power supply terminal, not shown) of the antenna element 12 is connected to a connection terminal (not shown) provided on the amplifier substrate 14 such that the amplifier substrate 14 amplifies wave signals received by the antenna element 12 and outputs the amplified signals.

The bracket 16 is made of, for example, relatively high-strength conductive metal material. The bracket 16 may be a press-formed or die-cast element. Further, the bracket 16 may be formed by a single element or two or more elements.

The amplifier substrate 14 is fixed to the bracket 16 by soldering or the like. An output connector 26 is connected to the amplifier substrate 14. The amplifier cover 20 for covering the amplifier substrate 14 is fixed by screwing, clipping, thermal caulking, adhesion, or the like to the bracket 16 to which the amplifier substrate 14 is fixed.

The GND bolt 18 fixes the antenna device 10 to the vehicle body 40. The GND bolt 18 is an example of a fixing member which functions as a ground (GND) of the antenna device 10. The GND bolt 18 is made of, for example, a conductive metal material. The GND bolt 18 is attached to the bracket 16 by spot welding or the like such that the GND bolt 18 and the bracket 16 are electrically connected. The GND bolt 18 and the bracket 16 may be attached by a method other than spot welding as long as they are electrically connected each other. The GND bolt 18 and the output connector 26 are positioned to protrude in the same direction with respect to the bracket 16 (away from the amplifier cover 20).

As shown in FIG. 3, an elastic member 22 such as a cushion or rubber is disposed on a surface of the amplifier cover 20 which faces towards the amplifier substrate 14 such that the elastic member 22 is provided covering the periphery of this surface of the amplifier cover 20. As an example of the rubber, ethylene-propylene-diene (EPDM) rubbers or the like may be used. The elastic member 22 is attached to the surface of the amplifier cover 20 by, for example, adhesive agent. The elastic member 22 ensures waterproofing of the amplifier cover 20 and also serves as measures for heat deformation of the spoiler 50.

The metal vehicle body 40 includes a through-hole into which the GND bolt 18 is inserted and another through-hole into which the output connector 26 is inserted. Similarly, the lower panel 54 includes a through-hole into which the GND bolt 18 is inserted and another through-hole into which the output connector 26 is inserted.

A harness 28 is connected to the output connector 26. The harness 28 is a group of wires including, for example, a signal wire for transmitting output signals from the amplifier substrate 14 and a power supply wire for supplying power to the amplifier substrate 14. The signal wire of the harness 28 is connected to the receiver mounted on the vehicle and the power supply wire of the harness is connected to the power supply device mounted on the vehicle. The signals amplified by the amplifier substrate 14 are output from the output connector 26 and supplied to the receiver via the harness 28.

The GND bolt 18 and the output connector 26 are inserted from the spoiler 50 side into the through-holes, each of which is formed on the lower panel 54 and the vehicle body 40 so as to attach the antenna device 10 to the vehicle body 40 from the lower panel 54 side. The antenna device 10 is fixed to the vehicle body 40 by attaching a nut 24, which is one example of the fixing member, from the vehicle body 40 side to the GND bolt 18 and tightening the nut 24.

According to the antenna device 10 having the above structure, effects and advantages described below can be achieved. Specifically, because the vehicle body 40 is made of metal and the bracket 16 and the vehicle body 40 are electrically connected by the GND bolt 18, a ground (GND) is provided by the GND bolt 18 immediately below the amplifier substrate 14. Because the GND is provided immediately below the amplifier substrate 14, it is possible to improve performance of the antenna device 10.

Further, the antenna device 10 is fixed to the vehicle body 40 by tightening the nut 24. In this way, the elastic member 22 provided with the amplifier cover 20 is compressed between the amplifier cover 20 and the vehicle body 40 (lower panel 54). When the elastic member 22 is compressed, the clearance between the amplifier cover 20 and the vehicle body 40 (lower panel 54) is filled with the elastic member 22. Therefore, it becomes possible to prevent water from penetrating into the amplifier cover 20 even when water such as rain has entered into the spoiler 50. That is, water penetration into the amplifier substrate 14 and the vehicle interior can be prevented by the elastic member 22, and thus waterproofing can be ensured. Therefore, because no molding is required, damage to elements on the amplifier substrate 14 can be avoided.

Further, because, when the spoiler 50 is deformed by heat expansion or contraction, the elastic member 22 can also be deformed along with such deformation of the spoiler 50, the clearance between the amplifier cover 20 and the vehicle body 40 (lower panel 54) remains filled with the elastic member 22. As a result, the waterproofing by the elastic member 22 can be ensured.

Further, because the antenna device 10 is fixed to the vehicle body 40 without being fixed to the spoiler 50, the amplifier substrate 14 is not displaced along with the heat deformation of the spoiler 50. Therefore, because no spring-shaped element as measures for the heat deformation is required, increase of the manufacturing cost can be suppressed.

Further, because the GND bolt 18 and the output connector 26 are positioned at the antenna device 10 such that the GND bolt 18 and the output connector 26 are placed towards the same direction, it becomes possible to assemble the antenna device 10 with the vehicle body 40 and the spoiler 50 by aligning the GND bolt 18 and the output connector 26 in one direction. Therefore, the positioning of the antenna device 10 to the vehicle body 40 and the spoiler 50 can be made easier. More specifically, if the GND bolt 18 and the output connector 26 are positioned to protrude in different directions, it would becomes necessary to assemble the antenna device 10 with the vehicle body 40 and the spoiler 50 by taking into account two axes (directions).

On the contrary, because the GND bolt 18 and the output connector 26 are positioned to protrude in the same direction in the antenna device 10 according to the present embodiment, the antenna device 10 can be assembled with the vehicle body 40 and the spoiler 50 by taking account of only one axis (direction), and thus the assembly can be easily performed.

Figure 4:
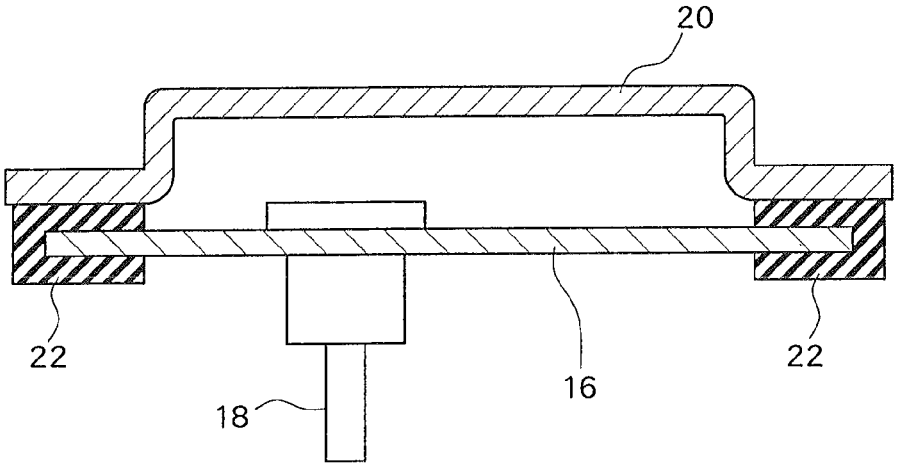
FIG. 4 is a cross-sectional view of another example of an antenna device.

If rubber instead of a cushion is used as the elastic member 22, the elastic member 22 may be fixed to the bracket 16. For example, as shown in FIG. 4, the rubber (elastic member 22) may be fixed to the outer periphery of the bracket 16 such that the rubber sandwiches the outer periphery of the bracket 16 from top and bottom to fix the bracket 16 to the amplifier cover 20. Even with the elastic member 22 fixed to the bracket 16 in this manner, the above mentioned effects and advantages can be achieved. It should be noted that the amplifier substrate 14 is omitted in FIG. 4.

Figure 5:
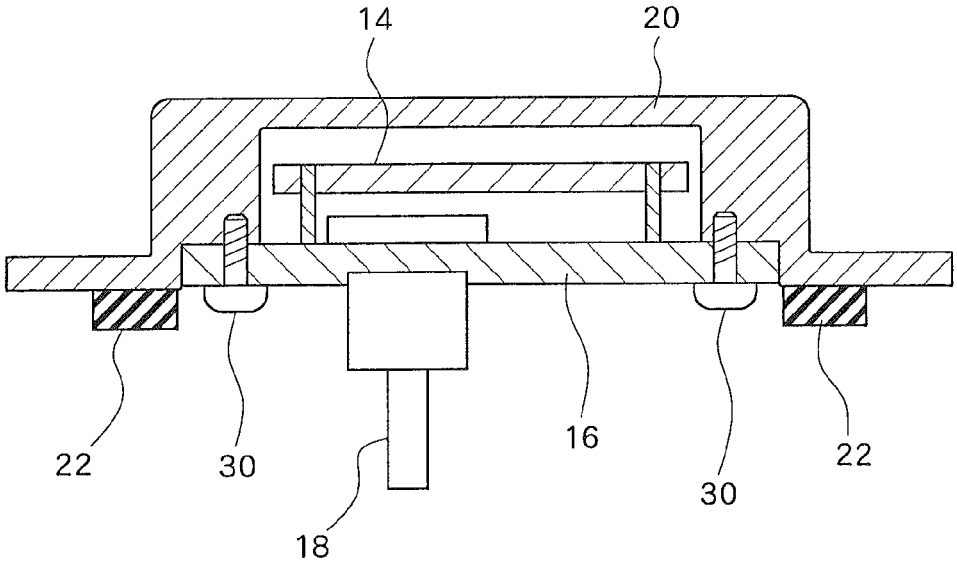
FIG. 5 is a cross-sectional view of yet another example of an antenna device.

Further, as shown in FIG. 5, the bracket 16 may be enclosed inside the amplifier cover 20 and fixed to the amplifier cover 20 by a screw 30 or the like. In this way, downsizing of the antenna device 10 becomes possible.

Further, as there is a possibility that the antenna device 10 will rotate when the nut 24 is tightened to the GND bolt 18 to fix the antenna device 10 to the vehicle body 40, a mechanism to stop the rotation of the antenna device 10 may be provided with the amplifier cover 20 or the bracket 16.

It should be noted that the mounting position of the antenna device 10 is not limited to inside the spoiler 50. The antenna device 10 may be positioned inside other exterior vehicle accessories.

The invention claimed is:

1. An antenna device disposed inside a vehicle exterior accessory mounted on exterior of a vehicle body, the antenna device comprising:

an amplifier which amplifies a wave signal received by an antenna element and outputs the amplified signal;

a bracket to which the amplifier is fixed;

a fixing member which fixes the bracket to the vehicle body and electrically connects between the bracket and the vehicle body;

an amplifier cover which is fixed to the bracket and covers the amplifier; and an elastic member provided covering an outer periphery of the amplifier cover between the amplifier cover and the vehicle body such that the elastic member is compressed as the amplifier cover is pressed against the vehicle body, the elastic member covering the bracket together with the amplifier cover, wherein the bracket is mounted on the vehicle exterior accessory with the elastic member being interposed therebetween; and, wherein the vehicle accessory is a spoiler.

2. The antenna device according to claim 1, wherein:

the fixing member includes a nut and a GND bolt which is fixed to the bracket; and the elastic member is compressed by tightening and fixing the bracket to the vehicle body by the bolt and the nut.

3. The antenna device according to claim 1, wherein the bracket is enclosed inside the amplifier cover.

4. The antenna device according to claim 2, wherein the bracket is enclosed inside the amplifier cover.

* * * * *